US008899304B2

(12) United States Patent
Ansoldi et al.

(10) Patent No.: US 8,899,304 B2
(45) Date of Patent: Dec. 2, 2014

(54) CRYSTALLIZER FOR CONTINUOUS CASTING

(75) Inventors: Marco Ansoldi, Udine (IT); Gianluca Bazzaro, Codroipo (IT); Andrea De Luca, Remanzacco (IT)

(73) Assignee: Danieli & C. Officine Meccaniche SpA, Buttrio (IT)

( * ) Notice: Subject to any disclaimer, the term of this patent is extended or adjusted under 35 U.S.C. 154(b) by 0 days.

(21) Appl. No.: 13/990,003

(22) PCT Filed: Nov. 24, 2011

(86) PCT No.: PCT/IB2011/002788
§ 371 (c)(1),
(2), (4) Date: Jul. 31, 2013

(87) PCT Pub. No.: WO2012/069910
PCT Pub. Date: May 31, 2012

(65) Prior Publication Data

US 2013/0327492 A1 Dec. 12, 2013

(30) Foreign Application Priority Data

Nov. 25, 2010 (IT) ..... UD2010A0214

(51) Int. Cl.

| | |
|---|---|
| ***B22D 11/00*** | (2006.01) |
| ***B22D 11/04*** | (2006.01) |
| ***B22D 11/124*** | (2006.01) |
| ***B22D 27/04*** | (2006.01) |
| ***B22D 11/055*** | (2006.01) |
| ***B22D 11/041*** | (2006.01) |

(52) U.S. Cl.
CPC ..... *B22D 11/124* (2013.01); *B22D 11/055* (2013.01); *B22D 11/041* (2013.01)
USPC ..... 164/418; 164/435; 164/444; 164/348

(58) Field of Classification Search
CPC .... B22D 11/059; B22D 11/04; B22D 11/055; B22D 11/041; B22D 11/049; B22D 27/04; B22C 9/065
USPC ..... 164/418, 435, 443, 444, 438
See application file for complete search history.

(56) References Cited

U.S. PATENT DOCUMENTS

| | | | |
|---|---|---|---|
| 2004/0069458 | A1 | 4/2004 | Hauri |
| 2006/0191661 | A1 | 8/2006 | Zajber et al. |

FOREIGN PATENT DOCUMENTS

| | | |
|---|---|---|
| JP | 50-027027 | 9/1975 |
| JP | 61-276749 | 12/1986 |

*Primary Examiner* — Kevin P Kerns
*Assistant Examiner* — Steven Ha
(74) *Attorney, Agent, or Firm* — Hamre, Schumann, Mueller & Larson, P.C.

(57) ABSTRACT

Crystallizer for continuous casting, having a monolithic tubular structure defined by lateral walls (12) in the thickness of which channels (11) are made in which a cooling liquid flows, wherein two adjacent lateral walls (12) define a corner or s edge zone. On at least one longitudinal portion (C) of at least one of the lateral walls (12) and/or of at least one of the corner zones, defining a zone in correspondence with which, during use, the meniscus of the liquid metal is located, a reduction in thickness (13) is made, starting from the external surface, determining a cross section with a reduced area with respect to the remaining longitudinal portions of the monolithic tubular structure.

10 Claims, 4 Drawing Sheets

CRYSTALLIZER FOR CONTINUOUS CASTING

FIELD OF THE INVENTION

The present invention concerns a crystallizer for continuous casting with a long working life.

The invention is used in the iron and steel field of technology to cast billets or blooms of any type and section, preferably square or rectangular but also polygonal in general.

BACKGROUND OF THE INVENTION

In continuous casting, reaching a high casting speed and therefore attaining an always higher productivity, while still maintaining both the surface and internal quality of the cast product high, is correlated to the optimization of a plurality of technological parameters relating both to the characteristics of the crystallizer and to the equipment connected to it, and also to the casting method.

Said parameters mainly concern the geometric and dimensional characteristics of the crystallizer, the primary cooling system, the lubrication system of the internal walls and the material the crystallizer is made of.

Such parameters affect the capacity of the crystallizer to support the high thermal and mechanical stresses and the wear to which it is subjected, thus in practice determining its operating life in conditions of great efficiency.

It must be considered that in a crystallizer there are, at the same time, thermal, mechanical and metallurgical phenomena which influence its longevity and performance.

A distinction must also be made when comparing the dimensions, since crystallizers for "small" products such as billets, have different problems compared to crystallizers for "big" products such as blooms. The former, especially in high speed applications, are extremely stressed from the thermal-mechanic point of view and typically the need to extend their working life is more keenly felt.

A good crystallizer must ensure a reduced distortion, so as to limit the phenomenon of "negative conicity", above all in the zone of the meniscus. It must also limit the onset and the spread of cracks on the internal surface. It must be able to limit the maximum temperature reached, for a defined couple of casting speed/dimension of the product.

With regard to the geometric and dimensional characteristics, crystallizers of a known type provide a substantially constant thickness of the walls over the whole length of the crystallizer, in particular in a zone comprised between the external surface of the crystallizer and the cooling holes, also called the cold part.

In particular, it is provided that the thickness of the copper wall is directly proportional to the sizes of the cast product, with a typical value of about one tenth of the side of the product.

Increasing the thickness, the conductive heat resistance also increases, so that, given the same heat flow set and the temperature of the cooling water, the maximum temperature also increases. Beyond a certain temperature, or "softening temperature", the mechanical properties of the copper show a sudden drop and there is a rapid deterioration of the geometric characteristics and resistance to wear of the crystallizer.

The maximum temperature reached depends on the conductive and convective resistances: the first is univocally determined by the thickness and type of copper, the second by the heat exchange coefficient that is obtained by the cooling fluid flowing inside the walls. It has been shown that the first resistance has a preponderant effect on the second.

For "small" products, with a limited copper thickness, cast at high speeds, the heat flows are very high and the distortions of the crystallizer become considerable, invalidating the internal conicity and consequently the continuity of contact between cast product and internal walls of the crystallizer. The lack of contact is harmful for the cast product since it reduces the heat exchange and may create surface defects, such as depressions and longitudinal cracks, as well as slowing the growth of the solid skin.

Given the above, it has happened that solutions adopted in known crystallizers entail, particularly in the zone around the meniscus, that is, the one subject to the highest temperatures in the casting steps of molten steel, a therm-mechanical conditioning of the tensional and deformative state of the crystallizer, limiting the casting speeds obtainable due to the localized plastic deformation of the crystallizer that causes the reduction in its working life.

Furthermore, due to the heat peak in correspondence with the zone of the meniscus, the temperature is not uniform along the crystallizer, which causes a non-uniform therm-mechanic deformation thereof due to the different thermal dilation of the material, with consequent problems connected to the defects of form that this plastic deformation causes on the cast product and the premature wear of the crystallizer, which reduces its working life.

A further problem is connected to maintaining the crystallizer in conditions of efficiency for long periods before having to resort to maintenance and/or replacement, deriving in particular from localized cracks in the zone of the meniscus caused by tensions and plastic deformation accumulated during the heating cycles.

In the crystallizers currently used it has been impossible to find a satisfying solution to all these problems, and indeed the attempt to solve them has instead led to accentuate others.

The prior art documents JP 61 276749 and US 2006/191661 show crystallizers with localized reductions in section, but these crystallizers do not have cooling channels made in the thickness of the copper walls and therefore the therm-mechanic and deformation behavior, in particular in the zone of the meniscus, is completely different from crystallizers equipped with such internal channels.

US 2004/0069458 describes solutions both with internal cooling channels and with cooling using an external jacket, and also with nozzles that spray cooling liquid against the external walls of the crystallizer. This document provides a reduction in thickness of the walls of the crystallizer starting from the top, and also establishes a fixed percentage ratio (in the order of 10%) between the thickness of the copper wall and the side of the cast product, so that as the size of the cast product varies, the thickness of the copper wall of the crystallizer also varies percentage-wise.

As a result of this approach, especially for "small" products like small-size billets, the therm-mechanic deformations and distortions to which the walls of the crystallizer are subject are particularly high. As stated, this can invalidate the internal conicity and therefore the correct contact between the cast product and the walls of the crystallizer, with a consequent reduction in the copper/steel heat exchange. This entails surface defects of the cast product, slows down the growth of the skin and causes bulging of the billet at exit from the crystallizer. To obviate these phenomena, it is necessary to reduce the casting speed and therefore the overall productivity of the plant.

It should also be noted that in U.S. '458 the reduction in thickness is independent of the presence or absence of the cooling holes, since the presence of the cooling holes passing through the walls of the crystallizer is a simple example, not binding for the purposes of the solution proposed.

The present invention therefore proposes to provide a response to all these problems, seeking a solution that allows, firstly, to increase the working life of the crystallizer in conditions of high casting efficiency, also taking into account the need to keep the internal shape, with its substantially conical development, as unchanged as possible.

Purpose of the present invention is therefore to obtain a crystallizer equipped with internal cooling channels which allows to reach high casting speeds and, at the same time, to achieve a high number of casting cycles, substantially reducing the possible therm-mechanic plastic deformations in the zone of the meniscus, so as to increase the working life of the crystallizer in conditions of high efficiency.

The Applicant has devised, tested and embodied the present invention to overcome the shortcomings of the state of the art and to obtain these and other purposes and advantages.

SUMMARY OF THE INVENTION

The present invention is set forth and characterized in the independent claim, while the dependent claims describe other characteristics of the invention or variants to the main inventive idea.

The principles of the invention are based on the consideration that the zone of the crystallizer most subject to therm-mechanic stresses is the one astride the meniscus, therefore comprising a strip which, in operating conditions, comprises the meniscus.

The thickness of the walls of the crystallizer, in particular in the zone of the meniscus, directly influences the mechanical resistance of the crystallizer and defines the degree of absorption of the therm-mechanic stresses generated by the high temperatures of the steel in the zone of the meniscus and therefore the degree of plastic deformation that the walls are subjected to in operating conditions.

Since the number of cycles until breakage, that is, the working life of the crystallizer, is inversely proportional to the plastic deformation accumulated in each cycle, it is extremely important to control the thermal field in the crystallizer in order to guarantee a prolonged working life in efficient conditions.

The crystallizer to which the invention is applied is characterized above all in having a monolithic tubular structure, with a square, rectangular or polygonal in general section, or even round, in which the sides which define the section can normally vary from 90 mm to 250 mm, while the longitudinal development has a length generally comprised between 900 and 1600 mm.

The crystallizer has lateral walls which, in the reciprocal coupling zone, define corner zones, or edges, possibly rounded.

The crystallizer to which the invention is applied has longitudinal channels for the passage of cooling liquid made directly in the thickness of its walls, and generally distributed in a substantially uniform manner on the walls.

Moreover, the crystallizer to which the present invention is applied has a conical internal profile which adjusts as the material cast progressively shrinks, from the entrance to the exit in relation to its progressive solidification.

In the context of the invention, an essential requisite is that the conical internal shape remains the same as the casting cycles continue, so as to always guarantee the dimensional quality and the shape of the cast product.

The crystallizer according to the present invention is also characterized by a high ratio between the thickness of the copper wall and the side of the cast product, for so-called "small" products, which can be as much as 20%, that is, it can have a thickness in the order of 30 mm for sizes of the side of the cast product of about 140-150 mm.

The value of about 30 mm is in any case maintained as the side of the cast product increases.

For "small" products, where the problems connected to the therm-mechanic deformation of the wall when casting at high speed are greater, the resistance of the walls is sufficiently high and able to contrast the effects of localized deformation; however, also for bigger products, the thickness of the walls is sufficiently rigid to guarantee that the internal conicity of the crystallizer is maintained.

According to a characteristic feature of the present invention, on at least one portion of at least one of the lateral walls of the monolithic tubular structure, and/or of at least one of said corner zones, in a zone in correspondence with which, during use, the meniscus of the liquid metal is located, at least a reduction in thickness is made, starting from the external surface of the lateral wall, which determines a cross section with a reduced area with respect to the remaining portions of the monolithic structure, wherein the reduction in thickness is made in such a manner that the residual thickness of the cold part of the wall, that is, the one outside the cooling channels with respect to the cast metal, is less than the diameter of the cooling channels, whereas the thickness of the wall between the cooling channels and the cast metal is always bigger than the thickness of the cold part.

This condition where the thickness is reduced, corresponding to a reduction in area of the cross section with the conditions indicated above, determines a slimming of the monolithic structure in correspondence with a zone astride the meniscus, with a desired height, correlated to the therm-mechanic resistance determined, also by the ratio between the hollow part (cooling channels) and the solid part (copper wall inside and outside the channels) so as to reduce the total deformation.

With the present invention therefore, astride the zone of the meniscus, where the therm-mechanic stresses are greater, reached due to the temperature peak and the risk of formation of localized cracks along the internal walls, we have a smaller deformation thanks to the slimmer cross section.

Furthermore, since as the area of the cross section diminishes there is also a reduction in the mechanical resistance, the reduction in thickness is obtained only locally, that is, around the zone of the meniscus, and not for the whole length of the crystallizer, thus performing its function only where there is a greater need to absorb the deformations.

With the parameters indicated above we thus obtain an optimum compromise between an increase in the absorption capacity of the therm-mechanic stresses in a localized and specific zone, and the mechanical resistance, so that, with all the parameters being equal, we have a reduction in the plastic deformations of the crystallizer as the casting cycles continue, with a consequent increase in the working life of the crystallizer in efficient conditions.

In some embodiments of the present invention, the thickness of the wall of the monolithic structure in the portion where the meniscus is formed is comprised between about 28 mm and about 15 mm, advantageously about 20/25 mm, so that, with the conditions described above, we have a condition where the diameter of the cooling channels is about 9 mm, the thickness of the wall between the cooling channels and the cast metal is about 10 mm, and the thickness of the wall of the cold zone outside the cooling channels is about 5-6 mm.

In a first solution, the reduction in thickness is achieved in correspondence with the zone where the meniscus is formed, over the whole external surface of one or some or all of the walls of the monolithic structure, thus defining a portion or strip of the crystallizer with a reduced thickness.

According to some embodiments of the invention, the reduction in thickness may provide that the one or more walls of the crystallizer have a uniform reduction along a plane parallel to the casting axis or, in a first variant, gradual along two inclined planes which intersect substantially in correspondence with the level of the meniscus, or again, in another variant, gradual but along hemispherical surfaces so as not to have rough edges.

According to other embodiments, the reduction in thickness on at least one wall may be uniform in a transverse direction, or according to a variant it may be smaller at the center and larger at the ends.

According to other embodiments, the profile of the external surfaces may be linear or curvilinear, or again rounded, that is, concave, or again convex.

In another variant, the reduction in thickness is achieved in correspondence with the zone where the meniscus is formed, along at least one, some or all of the edges defined between two or more walls of the monolithic structure so as to define corresponding bevels.

By bevels here we mean a reduction in cross section obtained by removing, in a zone astride the meniscus with respect to the remaining longitudinal parts of the crystallizer, a corner part of the walls defining an edge of the crystallizer.

In another variant, the reduction in thickness is the result of the combination between at least one bevel made on a corresponding edge, and the reduction in thickness of the external surface of at least one of the walls of the crystallizer: all the combinations of one or more bevels and one or more walls with reduced thickness are possible.

A possible embodiment of this solution is obtained by reducing the thickness of the walls on the whole perimeter of the crystallizer and then removing material in correspondence with the edges of the crystallizer.

In another embodiment, the reduction in thickness is achieved in correspondence with the zone where the meniscus is formed, on the whole external perimeter of the monolithic structure, that is, both on the surfaces and also along the relative edges.

BRIEF DESCRIPTION OF THE DRAWINGS

These and other characteristics of the present invention will become apparent from the following description of some preferential forms of embodiment, given as a non-restrictive example with reference to the attached drawings wherein.

DETAILED DESCRIPTION OF SOME PREFERENTIAL FORMS OF EMBODIMENT

With reference to the attached drawings, the number 10 indicates in its entirety a crystallizer according to the invention. The crystallizer 10 has a monolithic tubular structure in section, in this case square, with holes/channels 11 for the passage of a cooling liquid, made in the thickness of its lateral walls 12.

A typical section of the crystallizer 10 is for example square, but this type of section is only an example and in no way limiting in the context of the present invention.

Figure 3:
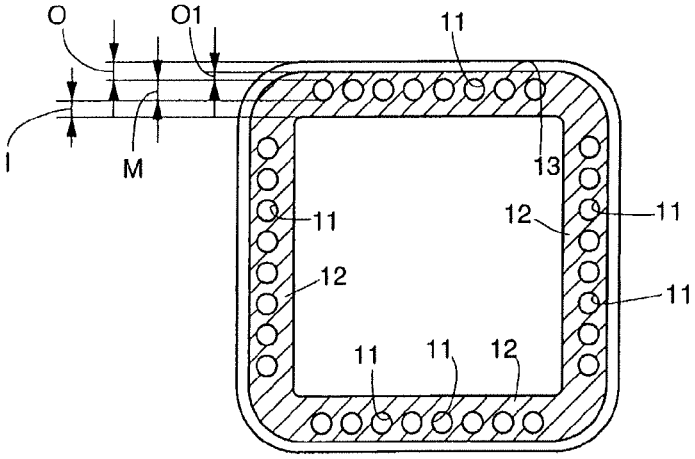
FIG. 3 shows an enlarged section made from III to III of FIG. 2.

The lateral walls 12 have a thickness of about 30 mm, divided for example into an external segment "O", about 11 mm, an intermediate segment "M", about 10 mm corresponding to the diameter of the holes 11, and an internal segment "I", about 9 mm (FIG. 3).

According to the invention, in a longitudinal portion C of the crystallizer 10, corresponding to a strip astride the zone where the meniscus forms, a reduction in thickness 13 is provided, starting from the external surface of the lateral walls.

The reduction in thickness determines a localized increase in the capacity to absorb therm-mechanic stresses, reducing plastic deformations to a minimum.

Figure 1:
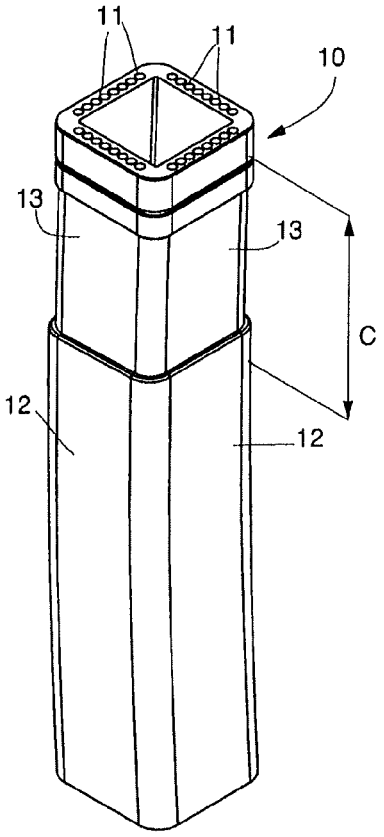
FIG. 1 shows a three-dimensional view of a first possible embodiment of a crystallizer according to the present invention.
Figure 2:
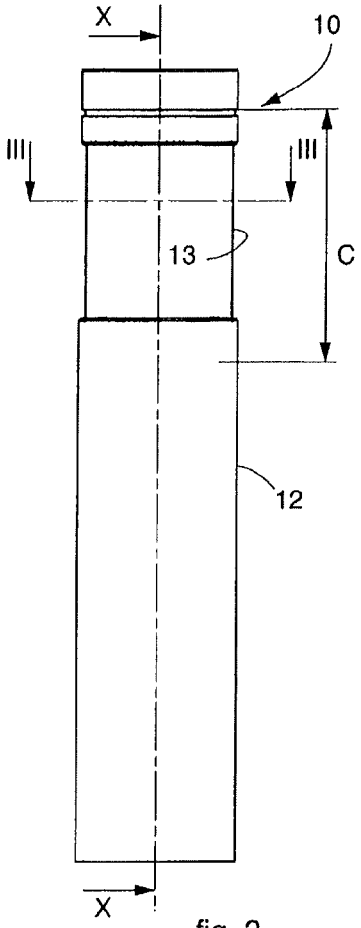
FIG. 2 shows a lateral view of the crystallizer in FIG. 1.

In the embodiment shown in FIGS. 1 to 3, the reduction in thickness 13 is made uniformly over the whole external perimeter of the monolithic structure, that is, in correspondence with the external surfaces of the lateral walls 12 and the edges defined by them.

In this embodiment, the reduction in thickness 13 provides that the resultant thickness is about 25 mm, divided, compared with the previous example, into an external segment "O1", about 5-6 mm, an intermediate segment "M", about 10 mm, corresponding to the diameter of the holes 11, and an internal segment "I", about 9 mm.

Therefore, the thickness of the wall of the cold part, in the zone "C" astride the meniscus, is smaller both than the diameter of the holes 11, and also than the thickness of the part of the wall comprised between the holes 11 and the cast metal.

Figure 4:
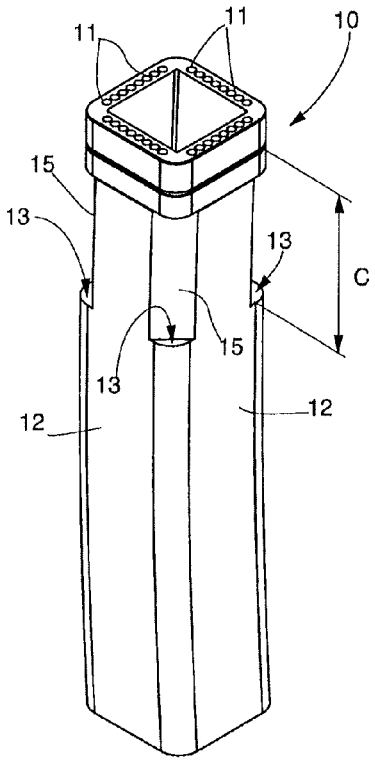
FIG. 4 shows a three-dimensional view of a second possible embodiment of a crystallizer according to the present invention.
Figure 5:
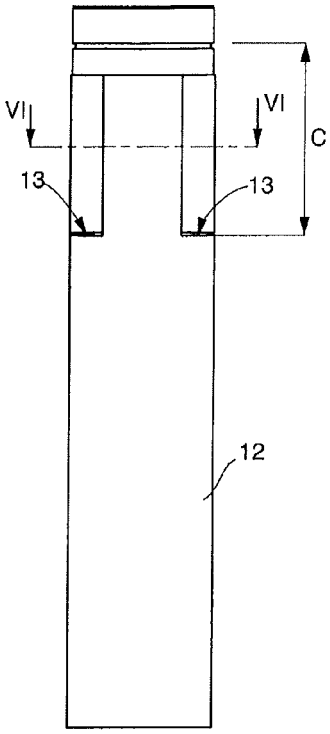
FIG. 5 shows a lateral view of the crystallizer in FIG. 4.
Figure 6:
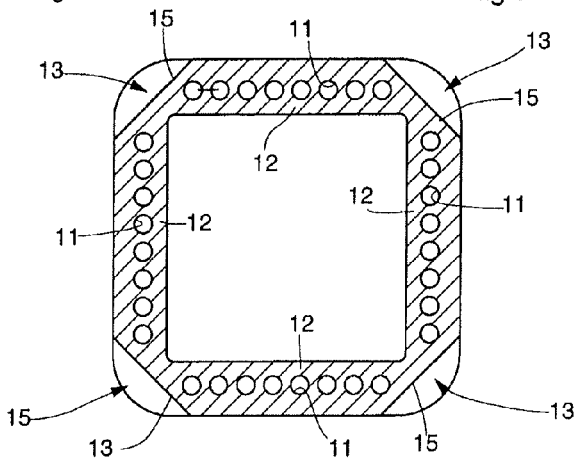
FIG. 6 shows an enlarged section made from VI to VI of FIG. 5.

In the embodiment shown in FIGS. 4 to 6, the reduction in thickness 13 is achieved only in correspondence with the edges defined between two adjacent lateral walls 12, substantially defining bevels 15 of the edges.

In this embodiment, the reduction in thickness 13 provides that the resultant thickness in correspondence with the edges is, for example, about 20 mm, whereas at the center of the lateral walls 12 the thickness remains about 30 mm as in the remaining portions of the crystallizer 10.

It should be noted that, in both solutions, the reduction in thickness 13 is achieved starting from the external part of the lateral walls 12, whether it is achieved on the surface or whether it is achieved on the edges.

This allows to keep unchanged the conformations of the internal surfaces of the crystallizer 10, where the liquid metal solidifies.

Furthermore, the absorption capacity determined by the reduction in thickness 13 is localized in portion C, where it is necessary to contrast the therm-mechanic stresses due to the high temperatures that are generated in the zone astride the meniscus and which, in the state of the art, determine the plastic deformation of the crystallizer 10. In the portions of the crystallizer 10 above and below portion C, no reductions in thickness 13 are provided, since there is less need for therm-mechanic absorption, at the same time guaranteeing effective structural and mechanical resistance. These alternative solutions may clearly be applied in any monolithic structural geometry and relative positions along the walls 12 of the crystallizer 10.

Figure 7:
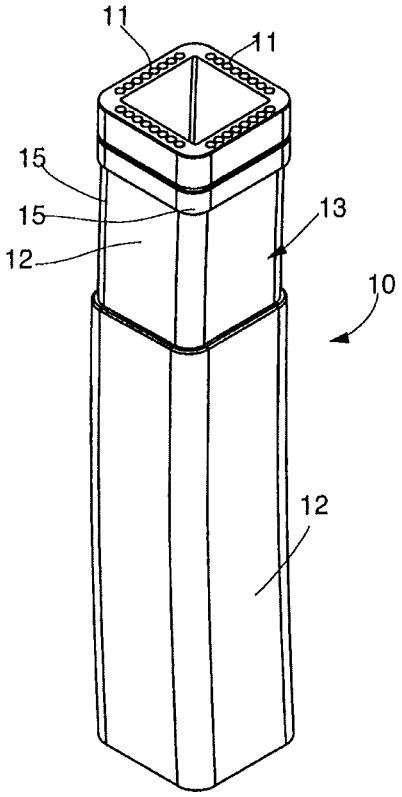
FIG. 7 shows a three-dimensional view of a third possible embodiment of a crystallizer according to the present invention
Figure 8:
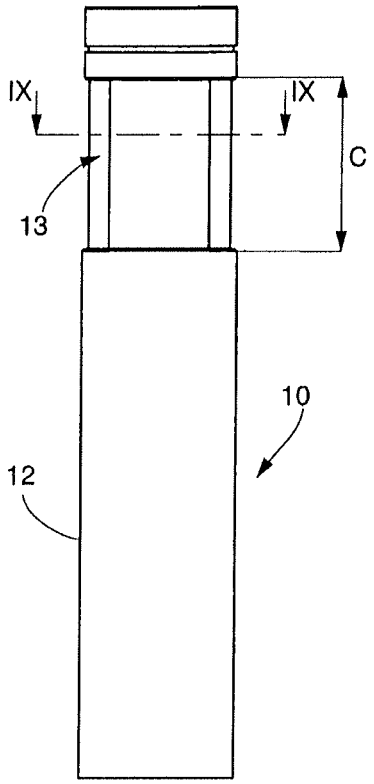
FIG. 8 shows a lateral view of the crystallizer in FIG. 7.
Figure 9:
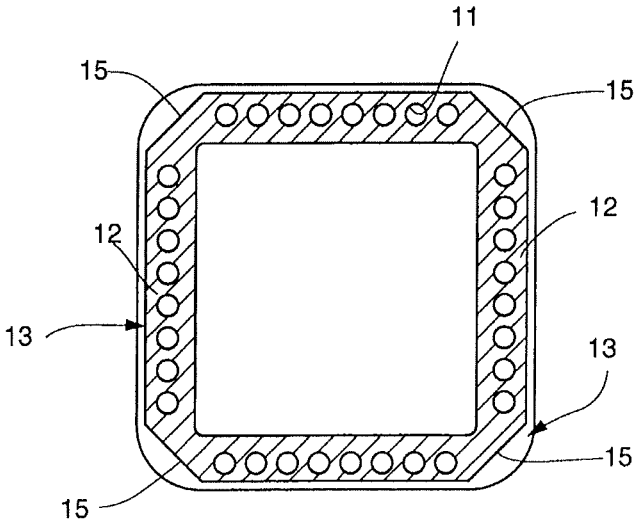
FIG. 9 shows an enlarged section made from IX to IX of FIG. 7.

In the other embodiment shown in FIGS. 7 to 9, the reduction in thickness is achieved both by reducing the thickness of the lateral walls 12 over the whole perimeter of the crystallizer 10, and also by making bevels 15 in correspondence with the corner zones, in this case in all the corner zones 15.

It is clear that, within the framework of the present invention, solutions are also comprised in which only some of the corner zones, or only some of the lateral walls, have a reduction in thickness with respect to zones below or above zone "C" of the crystallizer 10, given that the cross section area is reduced in its entirety.

Figure 10:
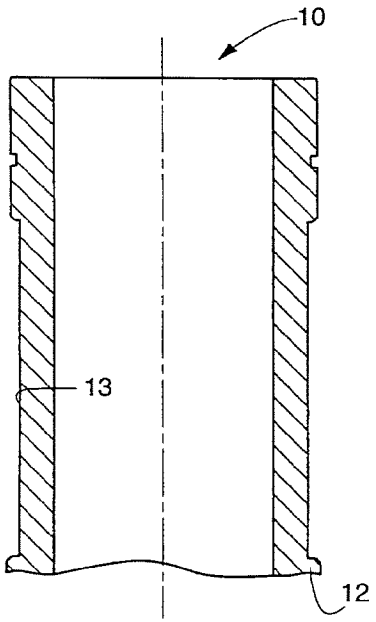

With regard to the longitudinal development of the reduction in thickness, FIG. 10 shows a first embodiment in which the walls 12 have a substantially uniform reduction in thickness 13 with a constant entity over the whole longitudinal segment concerned.

Figure 11:
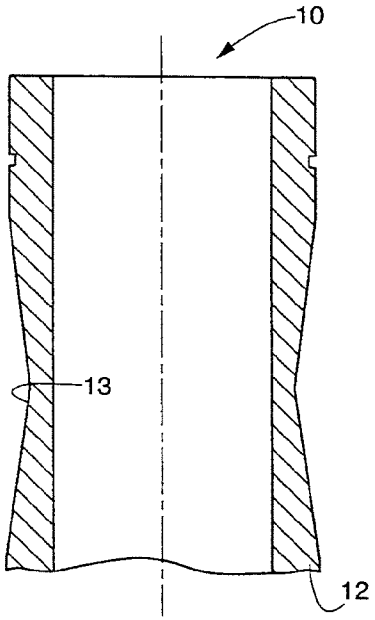

In the embodiment shown in FIG. 11, the reduction in thickness 13 is gradual starting from the upper end, until it reaches its maximum (with a consequent minimum thickness of the wall 12) in the zone corresponding to the meniscus, and then gradually regains its normal value corresponding to the thickness of the lower part of the crystallizer 10.

Figure 12:
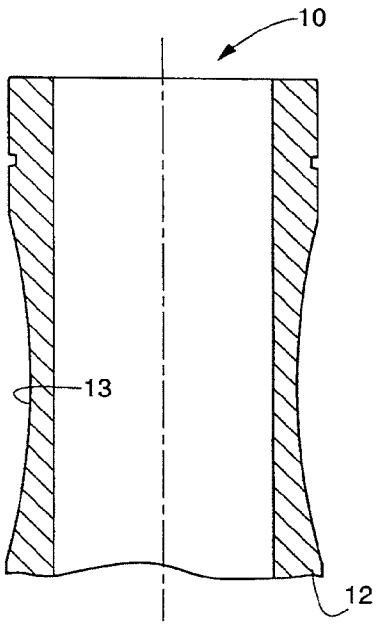
FIGS. 10-12 show other variants of the crystallizer according to the present invention.

In the other embodiment shown in FIG. 12, the gradual development of the reduction in thickness 13 is curvilinear, in this case too determining a minimum thickness of the wall in the zone corresponding to the meniscus, but preventing the formation of sharp edges in the wall 12.

In other embodiments, not shown, the reduction in thickness may be gradual in a transverse direction too, from the edges to the central zone of the wall, with inclined planes or with rounded curvilinear segments.

Modifications and/or additions may be made to the present invention, without departing from the field of protection as defined by the attached claims.

The invention claimed is:

1. A crystallizer for continuous casting of a metal product, the crystallizer comprising a monolithic tubular structure defined by lateral walls, the lateral walls including channels in the thicknesses of the lateral walls for circulation of a cooling liquid, wherein two adjacent lateral walls define a corner or an edge, at least one longitudinal portion which defines a zone in which, during use, a meniscus of a liquid metal is located, at least one of said lateral walls is provided with a reduction in thickness, starting from the external surface, said reduction in thickness having a cross section with a reduced area with respect to remaining longitudinal portions of the monolithic tubular structure, said reduction in thickness is such that a residual thickness of a cold part of the at least one of said lateral walls is less than the diameter of the channels, wherein the residual thickness is external to an external edge of the channels with respect to the liquid metal, and a thickness of the at least one of said lateral walls between an internal edge of the channels and the liquid metal is greater than the residual thickness of said cold part of the one of said lateral walls.

2. The crystallizer as in claim 1, wherein at least one of the thicknesses of the at least one of said lateral walls in correspondence with said at least one longitudinal portion is between about 28 mm and about 15 mm, portions other than said at least one longitudinal portion has a thickness of at least 30 mm, and the thickness of said portions other than said at least one longitudinal portion is always greater than said reduction in thickness.

3. The crystallizer as in claim 1, wherein the reduction in thickness is made over all of the external surface of the at least one of said lateral walls.

4. The crystallizer as in claim 1, wherein the reduction in thickness is made along at least one of the corner or the edge, and defines a bevel between said two adjacent lateral walls.

5. The crystallizer as in claim 4, wherein the reduction in thickness is a result of a combination of at least one bevel made on the a corner or the edge, and another reduction in thickness of the external surface of the at least one of said lateral walls.

6. The crystallizer as in claim 5, wherein the reduction in thickness is obtained by means of a reduction in the thickness of all the lateral walls over the whole perimeter and by making bevels in all the corner zones defined by two adjacent walls.

7. The crystallizer as in claim 1, wherein the reduction in thickness is made along the at least one of said lateral walls with a uniform reduction along a plane parallel to a longitudinal axis of the crystallizer.

8. The crystallizer as in claim 1, wherein the reduction in thickness is made along the at least one of said lateral walls with a gradual development along two inclined planes which intersect substantially in correspondence with the level of the meniscus.

9. The crystallizer as in claim 1, wherein the reduction in thickness is made along the at least one of said lateral walls with a gradual development along hemispheric surfaces.

10. The crystallizer as in claim 1, wherein the reduction in thickness on the at least one of said lateral walls is smaller at the center of the at least one of said lateral walls and greater at the ends thereof.

* * * * *